United States Patent [19]

Flanagan

[11] Patent Number: 4,856,981

[45] Date of Patent: Aug. 15, 1989

[54] MIXING RATE CONTROLLED PULSE COMBUSTION BURNER

[75] Inventor: Paul Flanagan, Northfield, Ohio

[73] Assignee: Gas Research Institute, Chicago, Ill.

[21] Appl. No.: 197,991

[22] Filed: May 24, 1988

[51] Int. Cl.[4] ..... F23C 11/04

[52] U.S. Cl. ..... 431/1; 60/39.77; 60/247

[58] Field of Search ..... 431/1; 60/39.77, 39.8, 60/247; 122/24

[56] References Cited

U.S. PATENT DOCUMENTS

| | | | |
|---|---|---|---|
| 2,900,790 | 8/1959 | Reimers | 60/39.77 |
| 3,143,160 | 8/1964 | Rydberg | 431/1 |
| 4,260,361 | 4/1981 | Huber | 431/1 |
| 4,457,691 | 7/1984 | Hisaoka et al. | 431/1 |
| 4,473,348 | 9/1984 | Tikhonovich et al. | 431/1 |
| 4,708,635 | 11/1987 | Vishwanath | 431/1 |

FOREIGN PATENT DOCUMENTS

| | | | |
|---|---|---|---|
| 1782940 | 4/1977 | Fed. Rep. of Germany | 431/1 |
| 114002 | 5/1986 | Japan | 431/1 |

*Primary Examiner*—Margaret A. Focarino

*Attorney, Agent, or Firm*—Pearne, Gordon, McCoy & Granger

[57] ABSTRACT

A pulse combustion burner is disclosed having a combustion chamber and a passageway for delivering a combustible gaseous mixture of air and fuel gas to the chamber. A self-feeding flapper valve and air and fuel gas flow restrictor members are positioned in close proximity along the passageway for metering the air and fuel gas flows through the passageway and combining the flows and enhancing quality and rate of mixing of the air and fuel gas.

23 Claims, 2 Drawing Sheets

MIXING RATE CONTROLLED PULSE COMBUSTION BURNER

BACKGROUND OF THE INVENTION AND PRIOR ART

The present invention relates to pulse combustion heating and, more particularly, to high fuel energy input pulse combustion burners wherein self-feeding of one or more components of a combustible gaseous mixture is effected with flow metering and immediate combination of the metered flows to enable mixing rate controlled pulse combustion and a large burner turndown range with adjustment of the fuel/air ratio.

In pulse combustion burners of the Helmholtz type, an oscillating or pulsed flow of combustion gases through the burner is maintained at a frequency determined by burner component geometry and fuel supply characteristics, including the mixing of components thereof. Typically, a combustion chamber of a given size cooperates with a tailpipe or exhaust pipe of specific dimensions to provide explosive combustion cycles, thermal expansion of the combustion gases, and oscillating gas pressures which provide the pulsed flow of combustion gases through the burner.

In order to make the pulse combustion process self-sustaining, the oscillating gas pressures may be used to provide self-feeding of one or more of the components of the combustible gaseous mixture which generally comprise air and a gaseous fuel such as natural gas. It is known to use one-way flapper valves to self-feed air and/or fuel gas to a pulse burner. Such flapper valves include a flexible flapper or diaphragm movably mounted between a valve plate having valve flow openings therein and a backer plate arranged to limit the movement or stroke of the flapper.

The operation and stability of pulse combustion burners are dependent upon the burner geometry and the degree of air and fuel mixing as indicated. These factors also affect the ease of initiating ignition and maintaining substantially complete combustion which is energy-efficient and within emission standards. Accordingly, pulse combustion burners are not readily amenable to operation over a wide turn-down range (maximum BTUH input rate/minimum BTUH input rate). The turn-down range in a typical pulse combustion burner is about 2:1. If the input rate is reduced below a minimum operating value, the process stability self-decays as reduced operating pressures result in correspondingly reduced fuel input rates until burner shut-down occurs. In a related manner, air and/or fuel supply variations may cause significant changes in the operation of the burner, including burner shut-down.

Burners of the type discussed above are mathematically modeled according to acoustic principles and are referred to as "acoustic controlled" hereinafter. In such burners, the air and fuel gas are typically mixed by injection into a mixing chamber along intersecting paths. The mixing chamber dimensions are determined by acoustic operation principles, and the mixing process is not further optimized. Such acoustic design limited mixing generally provides satisfactory mixing and homogeneous combustible gaseous mixtures in relatively low fuel energy input burners having input rates ranging up to about 200,000 BTUH, for example, burners of the size used in residential heating applications.

Even in pulse burner applications having inputs in the range of one to several hundred thousand BTUH, acoustic controlled mixing is not always sufficient to provide a homogeneous combustible gaseous mixture and to achieve efficient burner operation within emission standards over a range of operating conditions. In order to allow for cold start-up conditions and to control emissions of carbon monoxide (unburned fuel) and oxides of nitrogen, U.S. Pat. No. 4,260,361 discloses a multi-stage pulse combustion process wherein fuel gas is radially injected into a flow of air in a suction pipe for fuel-rich combustion in a primary combustion chamber followed by the injection of additional air and lean combustion in a downstream pulsation tube.

In larger sized burners, such as industrial burners having inputs of 700,000 BTUH and higher, acoustic controlled feeding of the combustible gaseous mixture has not been found to provide a homogeneous combustible gaseous mixture and smooth burner operation over a range of conditions, especially if a large burner turndown range is required. In such burners, failure to completely mix the air and fuel tends to result in incomplete combustion and higher carbon monoxide concentrations in the combustion products. This is believed to result from a reduced flame temperature and burn rate of the air and fuel mixture, the burner operation being characterized by an extended flame length. Burner operation is thus limited by the mixing rate of air and fuel gas. In order to achieve homogeneous air and fuel mixtures in such larger size burners, independently pulsed feeds of air and fuel have been used with computer-controlled variation of the composition of the feed in alternate cycles, complex shaped fuel mixer arrangements and auxiliary combustion chambers as shown in U.S. Pat. No. 4,473,348. In a substantially different approach, U.S. Pat. No. 4,708,635 teaches the series connection of a relatively smaller sized primary pulse burner and a substantially larger sized main pulse burner to provide an integrated combustion process wherein the primary burner provides operating and control characteristics.

SUMMARY OF THE INVENTION

In accordance with the present invention, mixing rate controlled pulse combustion is achieved by self-feeding at least one of the components of the combustible gaseous mixture using the burner pressure oscillations, flowing the components into the burner in response to the burner pressure oscillations along flow paths having restriction sites to meter the component flows, and combining the metered component flows in close proximity to their restriction sites and to the location of the self-feeding. The rate and quality of mixing of the components are enhanced by the close proximity or close coupling of the self-feeding, metering and combining of the component flows, which in turn increases the available combustion time in each pulse cycle. Therefore, the component flows may be varied over a relatively broad range with maintenance of a homogeneous combustible gaseous mixture to provide a large burner turndown range and mixing rate controlled operation.

Accordingly, it has now been discovered that the air and fuel gas components may be combined in a manner which favors mixing principles in order to achieve improved mixing rates and mixture homogeneity while maintaining acoustic burner operation. To that end, close coupling is used with acceleration of the flows of the components as they are metered and the components are combined by the transverse or combined transverse and swirling injection of the fuel gas component into the flow of the air component. In contrast, acoustic operation has been heretofore the primary design criterion for the mixing process.

The air and fuel gas component flows are combined substantially simultaneously with the completion of the metering thereof in order to maximize the static and dynamic energy of the component flows available for mixing as well as the available mixing and combustion time. Generally, restriction of the component flows for purposes of metering will involve acceleration of the flows with conversion of static pressure energy to dynamic momentum energy. Preferably, at least one of the component flows is significantly accelerated to increase its dynamic energy at the time of combination. The component flows are thereby intimately and rapidly mixed in a turbulent flow regime in order to provide a substantially homogeneous combustible gaseous mixture. This promotes reduced CO concentrations in the products of combustion which indicate more complete combustion in the relatively short explosive combustion cycles. The increased air and fuel mixing rate achieved in accordance with the invention tends to simulate high velocity burners by permitting a low excess oxygen level while still ensuring complete combustion. Accordingly, the mixing rate controlled burner better tolerates cold operation at start-up and non-stoichiometric operation. However, essentially stoichiometric operation is generally preferred as provided by adjustment of the metering of the component flows.

Also, the reduction of the length of the combustion flame extending in the direction of flow through the burner is believed to indicate a more turbulent flame having an increased surface area of flame front with an overall reduction in the flame length as compared with similarly sized acoustic controlled burners.

The improved mixing rates and achievement of more uniform homogeneous combustible gaseous mixtures over the range of burner operation and conditions of operation also provide improved reliability of ignition. This is particularly important in industrial size burners, since several cubic feet of fuel gas may be accumulated rapidly upon ignition failure.

In the illustrated embodiment, it is convenient to self-feed and meter the air flow since it is much larger than the fuel gas flow. For example, air is typically used in about a 10:1 ratio (by volume) when natural gas is the fuel gas.

The fuel gas is injected into the metered air flow through a plurality of nozzle openings located about the periphery of the air flow. The use of a plurality of fuel gas nozzle openings of relatively small areas enables acceleration of the fuel gas as it is combined with the air flow. Also, the nozzle openings may be connected to a common plenum or injector having a chamber for supplying fuel gas to the nozzle openings in response to burner pressure oscillations and decoupling the fuel gas flow to the nozzle openings from the upstream fuel gas supply arrangements. This arrangement also enables self-feeding of the fuel gas in response to burner pressure oscillations.

In the illustrated embodiment, a self-feeding flapper valve and component flow metering devices including the fuel gas injector are positioned in close proximity along a passageway for supplying the combustible gaseous mixture to the burner combustion chamber. In this manner, the available burner pressure oscillation energy for self-feeding of air is fully utilized and the energy spent due to the distance of conveyance of the air and fuel gas flows is minimized. The passageway may be aligned with the combustion chamber so that their axes intersect at a right angle. More preferably, the passageway may be arranged to tangentially inject the combustible gaseous mixture into the combustion chamber to provide a swirling flow of gases therein for further enhancing component mixing and stabilizing the combustion process.

DETAILED DESCRIPTION OF THE DRAWINGS

Figure 1:
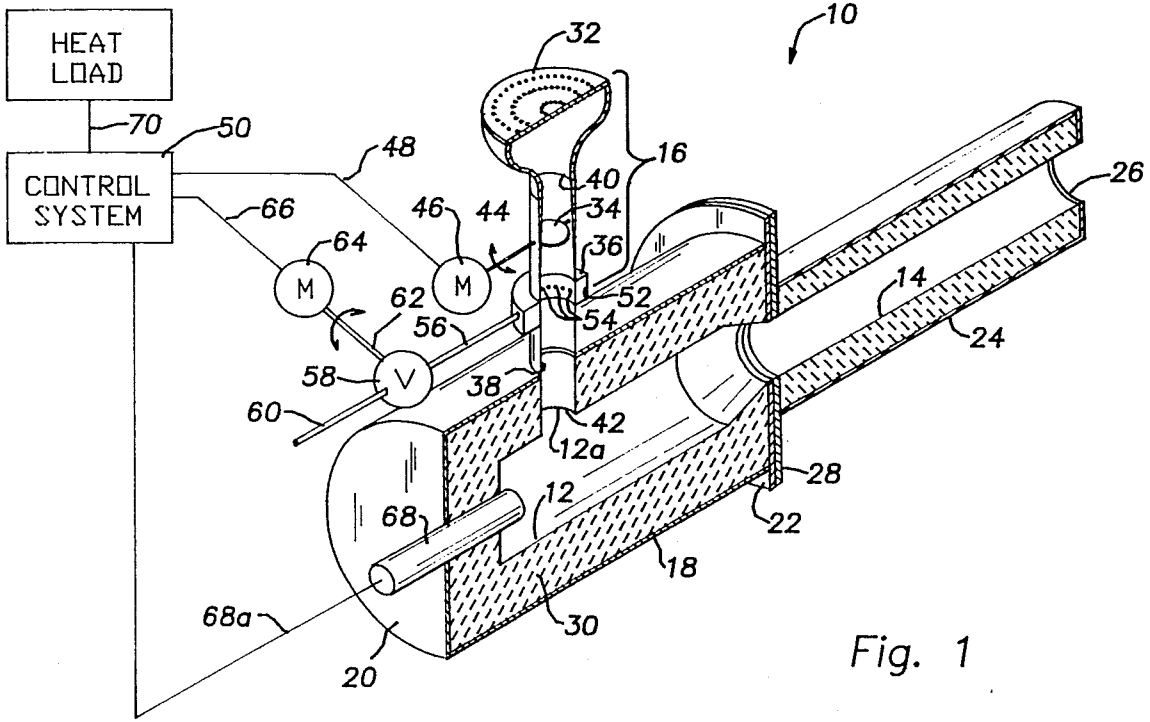
FIG. 1 is a diagrammatic, perspective view partially in section, showing a pulse combustion burner having close-coupled air and fuel gas feed in accordance with the present invention.

Referring to FIG. 1, there is shown a pulse combustion burner 10 having a combustion chamber 12 connected to a tailpipe or exhaust pipe 14 through which the products of combustion are vented. The burner also includes a close-coupled air and fuel gas feed 16 arranged to deliver a combustible mixture of gases to the chamber 12. The chamber 12 and tailpipe 14 are configured in accordance with acoustic principles to provide pulse combustion of the combustible mixture of air and fuel gas.

The burner 10 is an industrial-sized burner having a fuel energy input typically in excess of 1,000,000 BTUH. The burner 10 includes a plate metal shell 18 having a generally cylindrical configuration extending between a closed axial end 20 and an annular flange 22. A similar plate metal shell 24 surrounds the tailpipe 14 and includes an open axial end 26 at one end thereof and a flange 28 at the other end which is secured to the flange 22 of the shell 18. As shown, a refractory lining 30 is provided within the shells 18 and 24 for reasons of durability.

The close-coupled feed 16 includes as its major elements a flapper valve 32, a butterfly valve 34, and a fuel gas injector 36 which are positioned in close proximity along the length of a passageway 38. The passageway 38 has a generally cylindrical configuration extending in the direction of flow between a distal end 40 which is connected to the flapper valve 32 and a proximal end 42 which communicates with a combustion chamber inlet **12*a*. It should be appreciated that the elements of the feed 16 have been spaced and the axial dimensions of the passageway 38 exaggerated for clarity of illustration in FIG. 1**.

The flapper valve 32 is arranged to self-feed air through passageway 38 and into the combustion chamber 12 in response to the burner pressure oscillations. To that end, it is mounted in the passageway 38, the outlet of the valve 32 being in fluid communication with the distal end 40 of the passageway. As shown in FIG. 1, ambient air is drawn into the valve 32 to provide a flow of air into the passageway 38.

The flow of air through the passageway 38 is restricted by the butterfly valve 34 in accordance with an aligned or a flow-blocking orientation of the valve disc within the passageway 38. The position of the valve 34 is determined by the rotation of a control rod 44 which is driven by an actuator 46, which may comprise a stepping motor. The actuator 46 is connected via line 48 to a control system 50 which determines the direction and extent of rotation of control rod 44 and the position of the butterfly valve 34.

The fuel gas injector 36 includes a plenum or decoupler chamber 52 which has an annular configuration and surrounds the passageway 38. In response to burner pressure oscillations, fuel gas within the chamber 52 flows through a plurality of nozzle openings 54 for radial injection into the passageway 38 for combination with the air flowing therethrough. The nozzle openings 54 may be arranged to provide transverse fuel gas flows which intersect the longitudinal axis of the passageway 38. Also, some of the nozzle openings 54 may be aligned to provide fuel gas flows spaced from the longitudinal axis of the passageway 38 to result in a swirling gas flow.

The chamber 52 is sized to provide the fuel gas flowing therethrough with a space velocity (fuel gas volume flow rate/chamber volume) which provides a decoupler function by isolating the flow of fuel gas to nozzle openings 54 from unintentional and temporary pressure variations in the supply of fuel gas. It has been found that satisfactory decoupler operation is usually achieved with a space velocity of about 10 reciprocal seconds or less.

The number and size of the nozzle openings 54 are selected to assure a space velocity therethrough sufficient to prevent flashback. Nozzle designs providing space velocities therethrough in the order of 50,000 reciprocal seconds or more have been found satisfactory. Reverse flame spread through the injector is also prevented by the fact that the chamber 52 contains fuel gas at proportions or concentrations beyond the flammability limits. Accordingly, the proper sizing of the nozzle openings 54 and chamber 52 enables the injector 36 to prevent flashback and/or reverse flame spread in the same manner as a closed fuel gas flapper valve, and the latter is eliminated.

The fuel gas is delivered to the injector 36 via line 56, fuel gas metering valve 58, and fuel gas supply line 60 which is connected to a source of pressurized fuel gas (not shown). The flow of fuel gas to the injector 36 is controlled by the valve 58, which in turn is operated by control arm 62. The control arm 62 is driven by an actuator 64 which is connected to the control system 50 via line 66. In this manner, the flow of fuel to the burner 10 is regulated by the control system 50 in response to both sensed heat load conditions and/or manually selected operating conditions to determine the turn-down level of operation and/or the fuel/air ratio.

Upon start-up, an independent blower (not shown) may be used to provide initial air flow through the passageway 38 for combination with fuel gas delivered through injector 36 and ignition by the combined pilot flame and flame safety sensor 68. The pilot/sensor 68 is connected by line 68*a* to the control system 50 to cause fuel gas shut-off in the absence of combustion within the burner 10, as discussed more fully below.

The temperature of the heat load may be monitored with conventional thermostatic devices and input signals to the controller 50 may be provided with one or more input lines 70. In response to the monitored temperature of the heat load, the valves 34 and 58 are adjusted to provide appropriate flows of air and fuel gas in the desired proportions.

The control system 50 also allows for the manual turn-down of the burner. In accordance with the improved mixing rate controlled operation of the burner, satisfactory burner operation has been obtained for a turn-down range in excess of 12:1. In contrast, acoustically designed mixing typically displays no more than about 2:1 turn-down before loss of combustion.

Figure 2:
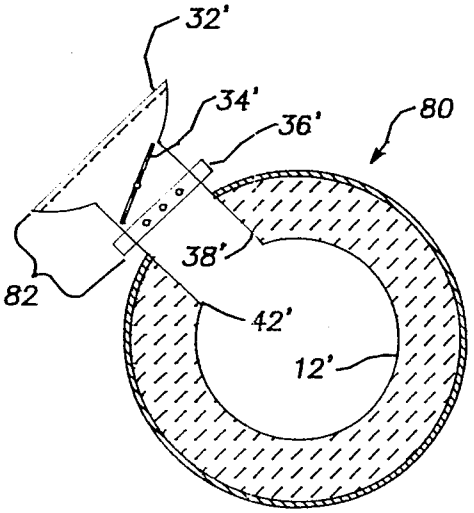
FIG. 2 is a diagrammatic, cross-sectional view, the plane of the section extending radially through the burner combustion chamber, showing a second embodiment of a pulse combustion burner.

Referring to FIG. 2, a modified pulse combustion burner 80 is shown. (For convenience, corresponding elements are similarly numbered in this embodiment with the addition of a prime designation.) The burner 80 particularly illustrates the close proximity or close-coupled air and fuel gas feed 82 in a 4,000,000 BTUH unit. In the burner 80, the combustion chamber 12' has a diameter of about 14 inches and an axial length of about 3 feet. The total axial distance from the end 42' of the passageway 38' to the outermost extremity of the flapper valve 32' is about 12 inches. The passageway 38' has a cylindrical configuration and a diameter of about 6 inches. As shown in FIG. 2, the butterfly valve 34' may be further opened so as to extend within the perimeter of the injector 36'.

Figure 3:
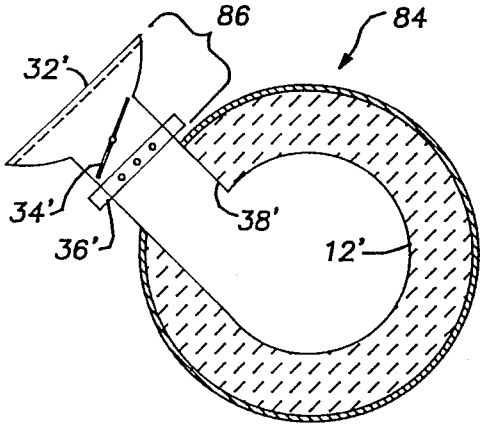
FIG. 3 is a diagrammatic view similar to FIG. 2 showing a third embodiment of a pulse combustion burner having a tangential feed arrangement.

In a preferred arrangement, the combustible gaseous mixture is tangentially injected into the combustion chamber to establish a swirling flow pattern therein. As shown in FIG. 3, a pulse combustion burner 84 has a close-coupled air and fuel feed 86 tangentially mounted with respect to the combustion chamber 12'. To that end, the longitudinal axis of the passageway 38' is radially offset from the longitudinal axis of the combustion chamber 12'. The tangential injection of the combustible gaseous mixture and resulting swirling flow pattern within the combustion chamber 12' enhance the mixing of the air and fuel gas components and provide more stable combustion. The turn-down range of such burner is thereby increased and turn-down operation in excess of 12:1 has been obtained.

Figure 4:
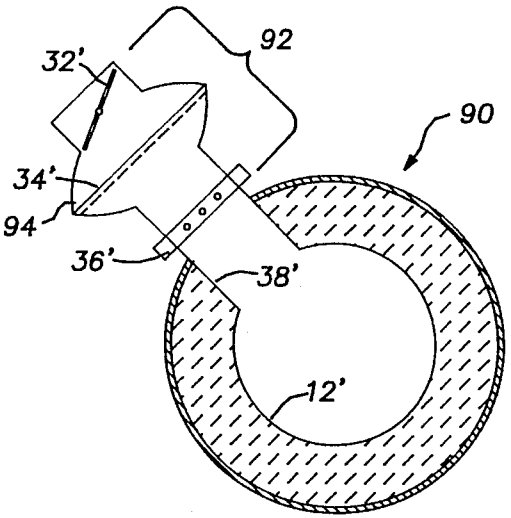
FIG. 4 is a diagrammatic view similar to FIG. 2 showing a fourth embodiment of a pulse combustion burner in accordance with the invention.

Referring to FIG. 4, a modified pulse combustion burner 90 is shown. The burner 90 includes a close-coupled air and fuel gas feed 92 having a butterfly valve 34' located in an air intake housing 94 outboard of the flapper valve 32'. A fuel gas injector 36' is located downstream of the flapper valve 32'. Even through the order of the elements of the feed 92 is altered, they remain closely positioned along the length of the passageway 38' and provide mixing rate controlled combustion.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not limited in scope and effect to the specific embodiments herein shown and described nor in any other way that is inconsistent with the extent to which the progress in the art has been advanced by the invention.

What is claimed:

1. A pulse combustion burner comprising a combustion chamber for explosive cyclic combustion of a combustible gaseous mixture of air and fuel gas with gas pressure oscillations occurring in the burner, said combustion chamber having an inlet for admitting said combustible gaseous mixture and an outlet for discharge of products of combustion of the gaseous mixture, a passageway having an axial flow direction for conveying said air, fuel gas, and combustible gaseous mixture thereof into said chamber inlet, air supply means including a self-feeding flapper valve and an adjustable air flow valve for delivering a controlled flow of air through said passageway, fuel gas supply means including an adjustable fuel gas flow valve and an injector for delivering a controlled flow of fuel gas through said passageway, said adjustable air and fuel gas flow valves being operable to vary the operation of said burner over a burner turn-down range and to vary the air-to-fuel ratio, said flapper valve, air flow valve and injector being located in close proximity along said passageway to cause mixing of said air and fuel gas within said passageway and to provide said combustible gaseous mixture as a homogeneous blend of air and fuel gas over said turn-down range.

2. A burner according to claim, 1, wherein said flapper valve is located upstream of said air flow valve.

3. A burner according to claim 1, wherein said air flow valve is located upstream of said flapper valve.

4. A burner according to claim 1, wherein said air flow valve is a butterfly valve.

5. A burner according to claim 4, wherein said butterfly valve is mounted in said passageway and includes a butterfly member operable between an open position aligned with the flow direction through the passageway and a flow restricting position transverse to the flow direction through the passageway.

6. A burner according to claim 1, wherein said injector includes a plurality of nozzle openings located at spaced locations around the periphery of said passageway for injecting fuel gas into the flow of air through said passageway in response to said gas pressure oscillations within said burner.

7. A burner according to claim 6, wherein said injector includes an annular decoupler chamber extending around said passageway and said nozzle openings are in fluid communication with said decoupler chamber.

8. A burner according to claim 7, wherein said decoupler chamber is sized to provide a space velocity of fuel gas therethrough of about 10 reciprocal seconds or less.

9. A burner according to claim 8, wherein said nozzle openings are sized to provide a space velocity of fuel gas therethrough of about 50,000 reciprocal seconds or higher.

10. A burner according to claim 7, wherein said burner has a designed fuel input rate of 1,000,000 BTUH or higher, said decoupler chamber and said nozzle openings being respectively sized to provide fuel gas space velocities therethrough of about 10 reciprocal seconds or less and 50,000 reciprocal seconds or higher when said burner is operated at its designed fuel input rate.

11. A burner according to claim 10, wherein said flapper valve, air flow valve, and injector are positioned along said passageway within a distance of about one foot from said combustion chamber inlet as measured along said flow direction.

12. A burner according to claim 1, wherein said air flow valve comprises a butterfly valve mounted in said passageway, said injector includes an annular decoupler chamber surrounding said passageway and a plurality of nozzle openings in fluid communication between said passageway and decoupler chamber for injecting fuel gas into the flow of air through the passageway in response to said gas pressure oscillations within said burner.

13. A burner according to claim 1, wherein said combustion chamber has a cylindrical configuration and said combustion chamber inlet is arranged to tangentially inject said combustible gaseous mixture into the chamber to provide a swirling gas flow therein.

14. A pulse combustion burner comprising a combustion chamber for explosive cyclic combustion of a combustible gaseous mixture of air and fuel gas components with gas pressure oscillations occurring in the burner, said combustion chamber having an inlet for admitting said combustible gaseous mixture and an outlet for discharging products of combustion of the gaseous mixture, a passageway for conveying said air, fuel gas, and combustible gaseous mixture thereof into said chamber inlet, air and fuel gas supply means for delivering controlled flows of air and fuel gas components and combustible gaseous mixture thereof through said passageway, said air and fuel gas supply means including a flapper valve for self-feeding at least one of the components of the combustible gaseous mixture through said passageway, air and fuel gas flow restriction means for metering the air and fuel gas component flows through said passageway, said flapper valve and air and fuel gas flow restriction means being arranged in close proximity along said passageway to maximize the static and dynamic pressure energy and time available for mixing said air and fuel gas components in response to said gas pressure oscillations occurring within said burner.

15. A burner according to claim 14, wherein said flow restriction means comprise flow restriction elements located in said passageway for respectively metering said air and fuel gas component flows.

16. A burner according to claim 15, wherein said air flow restriction element comprises a butterfly valve mounted in said passageway.

17. A burner according to claim 16, wherein said fuel gas flow restriction element comprises an injector mounted in said passageway.

18. A burner according to claim 17, wherein said injector includes a plurality of nozzle openings located at spaced locations about the periphery of said passageway for injecting fuel gas into the flow of air through said passageway.

19. A burner according to claim 18, wherein said injector includes an annular decoupler chamber extending around said passageway and said nozzle openings are in fluid communication with said decoupler chamber.

20. A burner according to claim 19, wherein said nozzle openings are sized to provide a space velocity of fuel gas therethrough of about 10 reciprocal seconds or less to prevent reverse flame spread and to effect turbulent flow conditions in the combining air and fuel gas component flows.

21. A burner according to claim 14, wherein said combustion chamber has a cylindrical configuration and a longitudinal axis extending along the flow direction through the chamber, and said passageway and combustion chamber inlet are arranged to tangentially inject said combustible gaseous mixture into the combustion chamber to provide a swirling gas flow therein.

22. A burner according to claim 21, wherein said passageway has a longitudinal axis extending along the flow direction through said passageway, and said passageway axis is spaced from said chamber axis.

23. A pulse combustion burner comprising a combustion chamber for explosive cyclic combustion of a combustible gaseous mixture of air and fuel gas components with gas pressure oscillations occurring in the burner, said combustion chamber having a cylindrical configuration extending between axially spaced chamber ends, a combustion chamber inlet adjacent one of said chamber ends for admitting said combustible gaseous mixture, and a combustion chamber outlet adjacent the other of said chamber ends for discharge of products of combustion of the gaseous mixture, ignition means in said combustion chamber for igniting said combustible gaseous mixture, a passageway having an axially extending flow direction for conveying said air, fuel gas, and combustible gaseous mixture thereof into said combustion chamber inlet, air supply means including a self-feeding flapper valve and an adjustable air flow valve mounted in said passageway for delivering a controlled flow of air through said passageway in response to said gas pressure oscillations within said burner, fuel gas supply means including an adjustable fuel gas flow valve and an injector for delivering a controlled flow of fuel gas through said passageway in response to said gas pressure oscillations within said burner, said adjustable air and fuel gas flow valves being operable to vary the operation of said burner over a burner turn-down range and to vary the air-to-fuel ratio, said flapper valve, air flow valve, and injector being located in close proximity along said passageway to cause mixing of said air and fuel gas within said passageway and to provide said combustible gaseous mixture as a substantially homogeneous blend of air and fuel gas over said turn-down range.

* * * * *